United States Patent [19]

O'Neal et al.

[11] Patent Number: 4,582,075

[45] Date of Patent: Apr. 15, 1986

[54] DISPOSABLE TOOTHBRUSH WITH MOUNTING HANDLE

[75] Inventors: Chester L. O'Neal, Greencastle, Ind.; Danny C. O'Neal, Corona, Calif.

[73] Assignee: Disposable Toothbrush, Inc., Bellevue, Wash.

[21] Appl. No.: 693,142

[22] Filed: Jan. 22, 1985

Related U.S. Application Data

[63] Continuation of Ser. No. 451,028, Dec. 20, 1982, abandoned.

[51] Int. Cl.[4] ..... A45D 44/18; B43K 23/02; B43M 11/06

[52] U.S. Cl. ..... 132/84 B; 401/131; 401/184

[58] Field of Search ..... 401/88, 89, 90, 98, 401/183, 184, 286, 287, 288, 269; 132/84 R, 84 B, 84 D, 9; 15/159 R, 159 A, 167 R, 167 A; D4/17, 22, 24; D28/73, 76, 77

[56] References Cited

U.S. PATENT DOCUMENTS

| | | | |
|---|---|---|---|
| 919,440 | 4/1909 | Lawson et al. | 401/269 |
| 1,049,863 | 1/1913 | Happle et al. | 401/286 |
| 1,563,190 | 11/1925 | House | 401/286 |
| 3,071,143 | 1/1963 | Bau | 132/84 R |
| 4,166,472 | 9/1979 | Battaglia | 132/9 |
| 4,221,492 | 9/1980 | Boscardin et al. | 401/184 |
| 4,288,883 | 9/1981 | Dolinsky | 15/159 A |
| 4,293,760 | 10/1981 | Smal | 132/33 F |
| 4,373,541 | 2/1983 | Nishioka | 132/84 R |
| 4,399,827 | 8/1983 | Fuhs | 401/286 |

*Primary Examiner*—Gene Mancene
*Assistant Examiner*—Carolyn A. Harrison
*Attorney, Agent, or Firm*—Fidelman, Wolffe & Waldron

[57] ABSTRACT

A disposable toothbrush having a squeezable handle with dentifrice therein. A cap is mountable to the brush to enclose the bristles and prevent dentifrice from escaping the brush. Each bristle includes a square cross-section and a radiused distal end. The end of the handle is sealed by a closure having a mounting pin hole to facilitate mounting of the brush in an upright position upon a mounting pin.

2 Claims, 5 Drawing Figures

DISPOSABLE TOOTHBRUSH WITH MOUNTING HANDLE

This application is a continuation of application Ser. No. 451,028, filed 12/20/82 now abandoned.

BACKGROUND OF THE INVENTION

This invention is in the field of disposable toothbrushes. In our U.S. Pat. No. 4,176,980, we disclosed a disposable toothbrush having a hollow squeezable handle containing dentifrice. By squeezing the handle, the dentifrice is forced onto the bristles. By further experimenting with our aforementioned brush, we designed a special snap-on closure sealing one end of the handle with the closure having a cavity therein allowing the entire brush to be mounted upright on a mounting pin precluding accidental contamination of the bristles with foreign objects such as a sink. Further, we have designed a particular bristle having an optimum configuration for application of the dentifrice and cleaning of teeth.

SUMMARY OF THE INVENTION

One embodiment of the present invention is a bristle comprising an upstanding main body of bendable material having one end mountable to a brush and an opposite free end, the main body tapering smaller in size from the one end to the free end.

A further embodiment of the present invention is a disposable toothbrush comprising a squeezable handle with a dispensing end and a filler end and forming a container extending therebetween to hold dentrifrice to be dispensed, a brush head connected to the dispensing end with the bristles extending outwardly therefrom and a passage opening adjacent the bristles and in communication with the container to receive the dentifrice onto the bristles when the handle is squeezed, and a closure sealingly mounted to the filler end of the handle and including a mounting pin receiving hole formed thereon to allow the handle to be mounted upright on the mounting pin.

It is an object of the present invention to provide a new and improved disposable toothbrush.

A further object of the present invention is to provide a disposable toothbrush having means for mounting the toothbrush in a upright position when not in use.

In addition, it is an object of the present invention to provide a brush bristle having an optimum design for contacting and cleaning a particular object.

Related objects and advantages of the present invention will be apparent from the following description.

DESCRIPTION OF THE PREFERRED EMBODIMENTS

Figure 1:
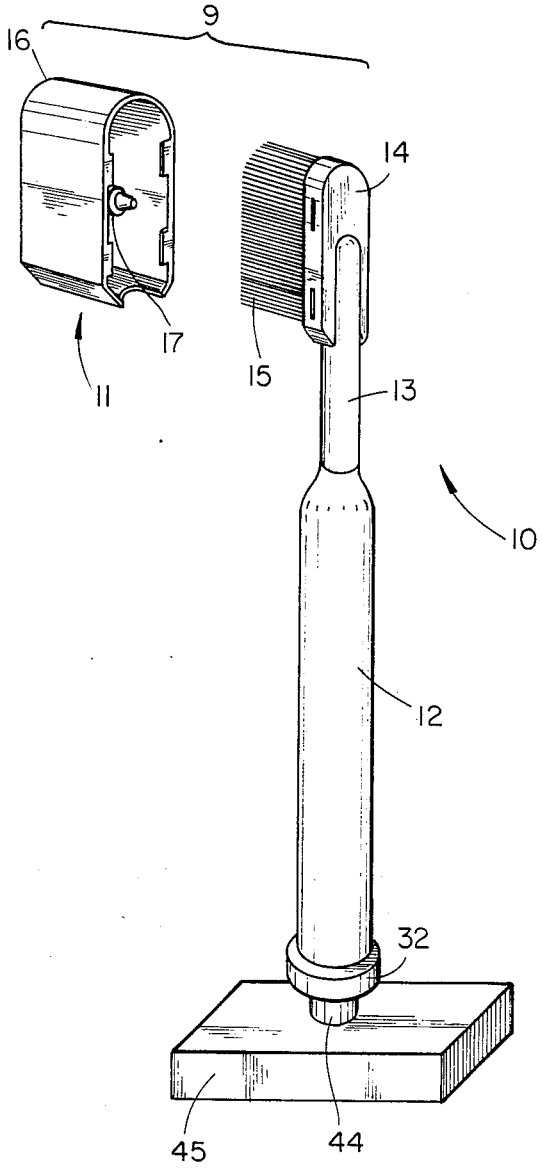
FIG. 1 is an exploded view of the toothbrush and cap incorporating the present invention.
Figure 3:
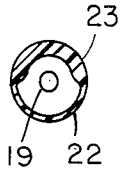
FIG. 3 is a reduced cross-sectional view taken along the line 3—3 of FIG. 2 and viewed in the direction of the arrows.
Figure 4:
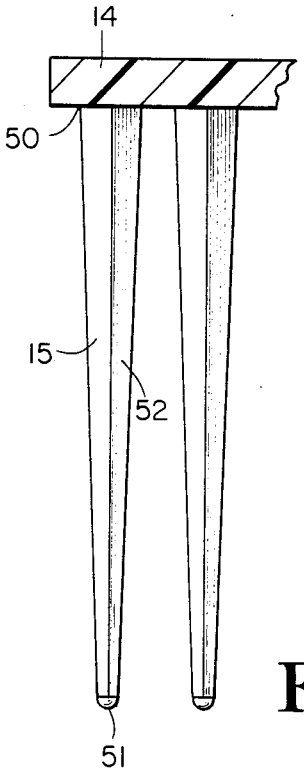
FIG. 4 is an enlarged side view of two of the bristles of the brush of FIG. 2.
Figure 5:
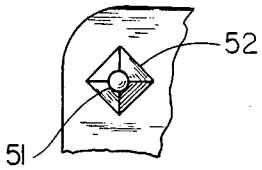
FIG. 5 is an end view of one of the bristles shown in FIG. 4.
Figure 2:
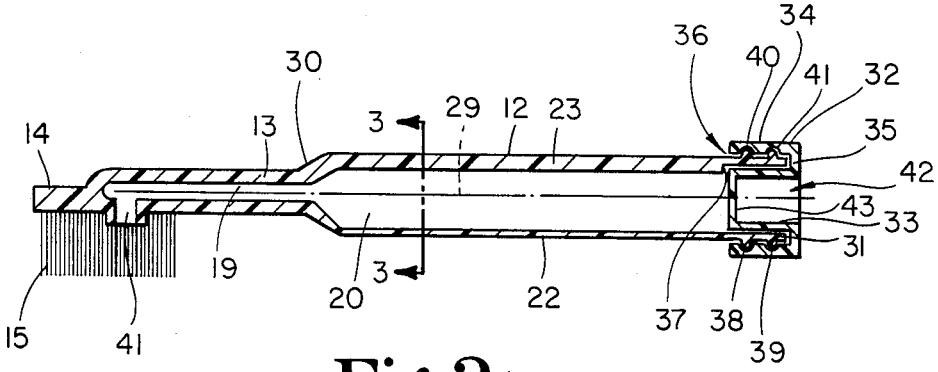
FIG. 2 is a longitudinal cross-sectional view of the brush of FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawings, there is shown a brush cap combination 9 with the particular combination shown being a toothbrush 10 with a cap 11 to removably mount to the brush and enclose bristles 15. Such a brush cap combination with the exception of the particular configuration of the bristles and the closure cap mounted to the opposite end of the handle is shown in the pending U.S. patent application Ser. No. 370,454, filed Apr. 21, 1982 by Chester L. O'Neal which is herein incorporated by reference.

Bristles 15 are cantileveredly mounted to the head 14 of the brush which is integrally attached by shank 13 to a hollow squeezable handle 12. A plug 17 is cantileveredly mounted to the box configured cap main body 16 and is insertable into opening 41 leading to passage 19 in turn in communication with the hollow interior 20 of handle 12. Passage 19 is aligned with the longitudinal center axis 29 of hollow interior 20. Handle 12 includes a semi-circular thick sidewall 23 integrally connected to a semi-circular thin sidewall 22 enabling the user to force wall 22 towards wall 23 thereby forcing some of the dentifrice through passage 19 and out opening 41 onto bristles 15.

The squeezable handle 12 of the disposable toothbrush 10 has a dispensing end 30 and a filler end 31 forming the container 20 extending therebetween. Brush head 14 is integrally connected to dispensing end 30 whereas a closure 32 is sealingly mounted to filler end 31 subsequent to the handle being filled with dentifrice.

Closure 32 includes a tubular body 33 integrally connected to a continuous ring 34 with the ring spaced apart from tubular body 33 except at the outer end 35 of the ring. Thus, ring 34 forms a cavity 36 into which the side wall of handle 12 projects. The thick side wall 23 of handle 12 extends from dispensing end 30 to a location 37 located between dispensing end 30 and filler end 31. The thin sidewall 22 is flexible whereas the thick sidewall is rigid. Thin sidewall 22 extends from location 37 to the end 31 of the handle and extends continuously around tubular main body 33 of closure 32. A pair of continuous ridges 38 and 39 are formed on wall 22 and project into a pair of continuous grooves 40 and 41. Thus, once the handle is filled with dentifice, the closure 32 may be snapped onto end 31 with the ridge and groove combination limiting movement between closure 32 and handle 12. Tubular main body 33 of closure 32 projects into filler end 31 forming a mounting pin receiving cavity 42 to allow the handle to be erectly mounted upright on a mounting pin 44 fixedly secured to base 45. The brush may therefore be removed from the mounting pin and used and then once again stored upon the pin which abuts against wall 43 of closure 32.

Each bristle 15 has a mounting end 50 fixedly secured to brush head 14 and an opposite free distal end 51. Each bristle 15 includes an upstanding main body of bendable material such as plastic. The main body 52 of each bristle tapers smaller in size from end 50 to end 51. Main body 52 includes a polygonal or quadrangular cross-section. The four sided main body 42 is actually square in configuration with the free end 51 being radiused and having a semi-circular configuration. The width of each bristle decreases linearly from end 50 to end 51. In one embodiment, each bristle was approximately 0.390 inches in length with the diameter of the free end 51 being 0.012 inches across and with each bristle having an included angle taper of approximately 4°.

It will be obvious from the above description that the present invention provides a new and improved disposable toothbrush. Also, it will be obvious that the toothbrush disclosed herein is particularly useful in that a mounting end cap is provided to space the bristles apart from a normal support surface such as a sink.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A disposable toothbrush device comprising:

a squeezable handle with a dispensing end and a filler end, said handle forming a container extending therebetween to hold dentifrice to be dispensed, said handle including a side wall forming said container;

a brush head connected to said dispensing end with bristles extending outwardly from said brush head and a passage opening adjacent said bristles and in communication with said container to receive said dentifrice onto said bristles when said handle is squeezed;

a mount including a base and a pin extending outwardly therefrom; and a closure sealingly mounted to said filler end of said handle and including a hole formed thereon mountingly receiving said pin to allow said handle to be mounted upright on said mount, said closure including a tubular body and a ring integrally connected together, said tubular body projecting into said filler end with said ring extending therearound, said ring having at least a portion thereof spaced apart from said tubular body forming a cavity into which said side wall of said handle projects, said side wall extending the length of said handle and including a flexible thin portion and a rigid thick portion, said thick portion extending from said dispensing end to a location immediately adjacent said filler end whereat said thick portion is reduced in thickness to said thin portion allowing said thin portion to extend therefrom and cylindrically around said tubular body in said cavity, said thin portion also extending from within said cavity along substantially the length of said container and being flexible to allow dentifrice within said container to be squeezed therefrom.

2. The toothbrush device of claim 1 wherein said side wall and ring have a cooperating ridge and groove mating combination, allowing said closure to be snapped onto and held on said filler end.

* * * * *